US006463157B1

(12) United States Patent
May

(10) Patent No.: US 6,463,157 B1
(45) Date of Patent: Oct. 8, 2002

(54) BONE CONDUCTION SPEAKER AND MICROPHONE

(75) Inventor: David F. May, Columbus, IN (US)

(73) Assignee: Analytical Engineering, Inc., Columbus, IN (US)

( * ) Notice: Subject to any disclaimer, the term of this patent is extended or adjusted under 35 U.S.C. 154(b) by 0 days.

(21) Appl. No.: 09/221,356

(22) Filed: Dec. 28, 1998

Related U.S. Application Data

(60) Provisional application No. 60/103,205, filed on Oct. 6, 1998.

(51) Int. Cl.[7] ..... H04R 25/00

(52) U.S. Cl. ..... 381/151; 310/324; 310/800; 381/326; 381/380; 381/190

(58) Field of Search ..... 381/151, 326, 381/380, 190, 173, FOR 130; 310/324, 800

(56) References Cited

U.S. PATENT DOCUMENTS 3,764,748 A * 10/1973 Branch
3,978,353 A * 8/1976 Kinoshita
4,220,831 A * 9/1980 Zink
4,535,205 A * 8/1985 Ravinet
4,596,903 A * 6/1986 Yoshizawa
5,434,924 A * 7/1995 Jampolsky
5,574,794 A * 11/1996 Valley
5,796,854 A * 8/1998 Markow
5,889,871 A * 3/1999 Downs

* cited by examiner

*Primary Examiner*—Curtis Kuntz
*Assistant Examiner*—Dionne N. Harvey
(74) *Attorney, Agent, or Firm*—Taylor & Aust, P.C.

(57) ABSTRACT

A bone conduction microphone and speaker mountable in contact with a user's head or head area, each utilize a strategically mounted audio transducer that is preferably a piezoelectric ceramic bender. In the case of the speaker, the bender is coupled to an audio transformer which may or may not be potted with the bender within the same housing. Additionally, the speaker bender is mounted on a foam layer either with or without a supporting shelf depending on the desired application. The microphone bender is potted within the housing and includes a JFET and resistor mounted directly to the elements of the bender. The present microphone is designed to create the largest possible acoustic mismatch with air while nearly matching the acoustic impedance to the human skill structure. This attenuates the amount of ambient air noise coupled sound receivable into the microphone by greater than 80 dB. The speaker is designed with acoustic impedance matched for bone conduction sound.

9 Claims, 2 Drawing Sheets

BONE CONDUCTION SPEAKER AND MICROPHONE

CROSS REFERENCE TO RELATED APPLICATIONS

This is a non-provisional U.S. patent application based upon provisional U.S. patent application Ser. No. 60/103,205, filed Oct. 6, 1998, entitled "BONE CONDUCTION ACOUSTIC COMMUNICATION".

BACKGROUND OF THE INVENTION

1. Field of the Invention

The present invention relates to bone conduction audio communication systems and, more particularly, to bone conduction audio speakers and microphones.

2. Description of the Related Art

Most conventional audio listening and/or communication systems do not use bone conduction. Instead, such conventional systems provide sound to the listener utilizing normal air conduction via the ear canal. Such conventional systems are used in a variety of applications or activities. One type of well known air conduction system is the headphone or earphone that is placed over the ear and transmits sound to the user via the ear canal. As well, conventional microphones utilize air vibration transducers to translate incoming air movement (sound/audio) into electrical pulses.

In contrast, it is also known to provide bone conduction microphones that utilize energy generated by auditory vibrations of the bones of the head. Generally, these types of microphones utilize an inertial-type or low mass accelerometer transducer which is placed in intimate contact with the head to detect bone vibrations and then generate output signals responsive to the vibrations.

However, these types of microphones are adversely affected by ambient noise transmitted through the air as well as through mounting equipment. Also, the audio quality is generally poor because the transducer cannot be held in intimate contact with the head with a sufficient, but comfortable, pressure so as to pick up or detect all frequencies of sound, especially high frequencies.

What is therefore needed in the art is a bone conduction audio communication system having both a microphone and speaker that overcomes the deficiencies of the prior art.

SUMMARY OF THE INVENTION

The present invention provides a bone conduction microphone and speaker which comprise separately and together a communication system. Both the speaker and microphone are designed to be in contact with the head, head area, or on the mastoid of a user.

The present microphone is constructed with materials and geometries such that the acoustic impedance thereof is nearly matched to the human skull structure. Additionally, the present microphone is designed to create the largest possible acoustic mismatch with air, attenuating ambient air coupled sound by greater than 80 dB, thereby almost completely eliminating air coupled sound reception. Further, the present microphone is specific to vibrations which exist in the human flesh and is specifically not sensitive to ambient air coupled vibrations, while at the same time being constructed with simple and inexpensive components.

In one form thereof, the microphone comprises an audio transducer potted within a low profile plastic housing and including a transistor and resistor mounted directly to the audio transducer.

The audio transducer is preferably a piezoelectric ceramic bender having a ceramic element disposed on a metallic vibration element and of appropriate operating characteristics. A Junction Field Effect Transistor (JFET) has the gate thereof electrically coupled to the ceramic element, the source thereof electrically coupled to the metallic vibration element, and the drain electrically coupled to the output conductor. The resistor has one end electrically coupled to the ceramic element and the other end coupled to the metallic vibration element.

The present speaker is a bone conduction transduction device with acoustic impedance matched for bone conduction sound. The speaker is placed in intimate contact with the head or head area of the user such that sound generated thereby is injected directly into the skull creating a minimum of ambient air excitation.

In one form thereof, the present speaker comprises an audio transducer and audio transducer potted within a plastic housing. The audio transducer is supported on a foam layer disposed between the audio transducer and audio transformer. Depending on the application, the audio transducer may also be supported on a shelf of the housing.

The audio transducer is preferably a piezoelectric ceramic bender having a ceramic element disposed onto a metallic vibration element and of appropriate operating characteristics. The ceramic element is preferably disposed adjacent a protective polyurethane layer.

In another form thereof, the present speaker comprises an audio transducer potted within a plastic housing and disposed adjacent a foam layer, and electrically coupled via a cable to an audio transducer potted within a separate plastic housing. The audio transducer is supported on a foam layer disposed between the audio transducer and audio transformer. Depending on the application, the audio transducer may also be supported on a shelf of the housing.

It is an advantage of the present invention that the specific microphone and speaker designs can be independent of the application.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
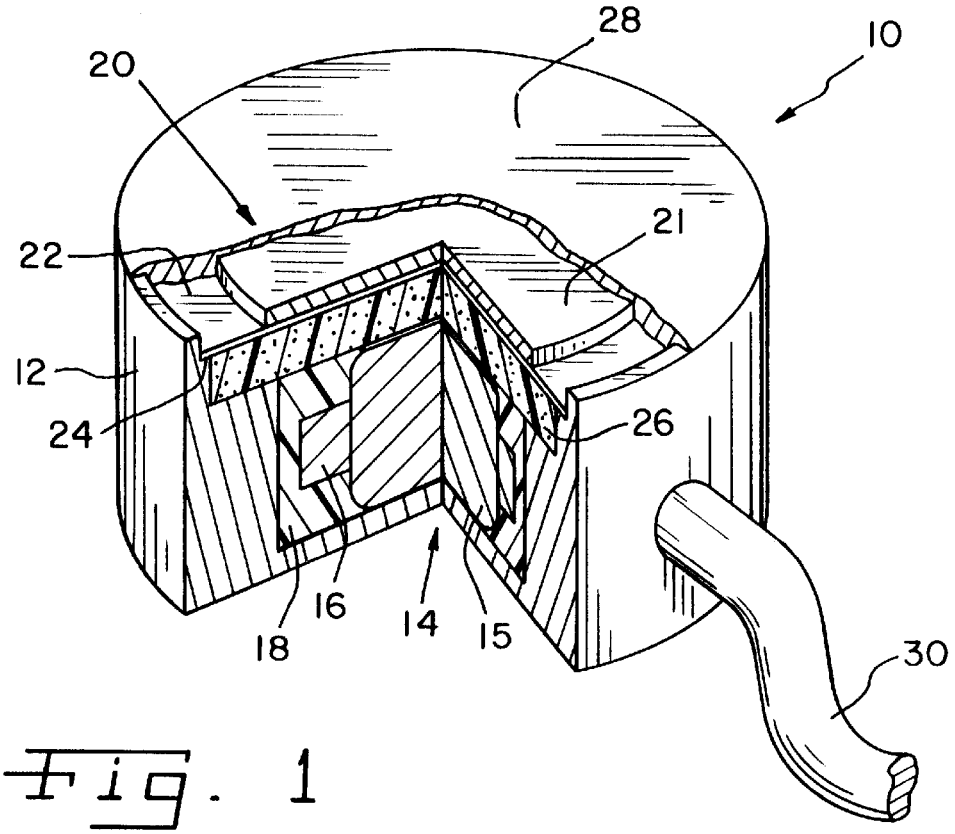
FIG. 1 is a front, partial section, perspective view of an embodiment of a speaker in accordance with the principles present invention.

Corresponding reference characters indicate corresponding parts throughout the several views. The exemplifications set out herein illustrate preferred embodiments of the invention, in several forms, and such exemplifications are not to be construed as limiting the scope of the invention in any manner.

DETAILED DESCRIPTION OF THE INVENTION

Referring now to the drawings, and more particularly to FIG. 1, there is shown high profile speaker or high profile integral speaker 10. High profile speaker 10 has housing 12 made of a machined or thermoformed plastic such as ABS or another thermoplastic or thermoset polymer. Disposed within housing 12 is audio transformer 14 comprised of primary winding 15 and secondary winding 16 preferably having a turns ratio of approximately 10:1 and a peak performance at approximately 25–2000 Hz. One type of audio transformer that may be used is a Radio Shack® P/N 273-1380. Surrounding transformer 14 is epoxy potting 18 which provides protection and electrical insulation. One type of epoxy that may be used is known as 20-3060, a 100% reactive potting and encapsulating epoxy resin from Epoxies, Etc. Inc. of Greenville, R.I. Surrounding epoxy potting 18 is the plastic of housing 12 except for the upper portion thereof.

Wired to the high voltage side of transformer 14 is audio transducer 20. Audio transducer 20 is preferably a piezo ceramic bender such as standard piezo ceramic bender part number KBI 3526 from Projects Unlimited, Inc. in Dayton, Ohio that has a resonant frequency of 2600 Hz. Bender 20 has annular piezo ceramic element 21 and non-ceramic or metal substrate vibration element 22. In the case of the KBI 3526, piezo ceramic element 22 has a diameter of 25 mm (0.984") and a thickness of 0.28 mm (0.011"), while non-ceramic vibration element 21 is brass and has a diameter of 35 mm (1.378") and a thickness of 0.25 mm (0.010") for an overall bender 20 thickness of 0.53 mm (0.021"). Of course, other bender configurations or audio transducers may be used according to the principles of the present invention.

Depending on the application, either above or below water applications, bender 20 is situated within housing 12 in one of two ways. In above water or non-diving applications, non-ceramic vibration element 22 of bender 20 is supported on its outside diameter by annular or other configuration shelf 24, that is preferably only approximately 0.050 inches wide around its circumference. Disposed between bender 20 and transformer 14 is closed cell foam layer 26 that provides support for bender 20 in case of compression. This helps prevent cracking piezo ceramic element 21 of bender 20. For underwater applications, however, non-ceramic vibration element 22 of bender 20 is not supported by a shelf but is directly supported on closed cell foam layer 26. This allows for near uniform forces to be exerted over the entire surface area of bender 20 during such submersed applications. Again, this helps prevent cracking of piezo ceramic element 21.

Disposed onto the top of bender 20 is polyurethane layer 28, preferably of a 40–60 shore A or high viscosity resin polyurethane. The profile of polyurethane layer 28 is preferably nominally hemispherical and does not extend beyond the diameter of housing 12. Electrical connection of transformer 14 and bender 20 is achieved by two or three conductor cable 30 that extends through housing 12 and is retained within housing 12 by epoxy potting 18 to provide protection, electrical insulation, and a secure structure. Preferably, cable 30 is a PVC or polyurethane jacketed material with conductor sizes nominally at least 26 gauge, but no larger than 20 gauge.

Figure 2:
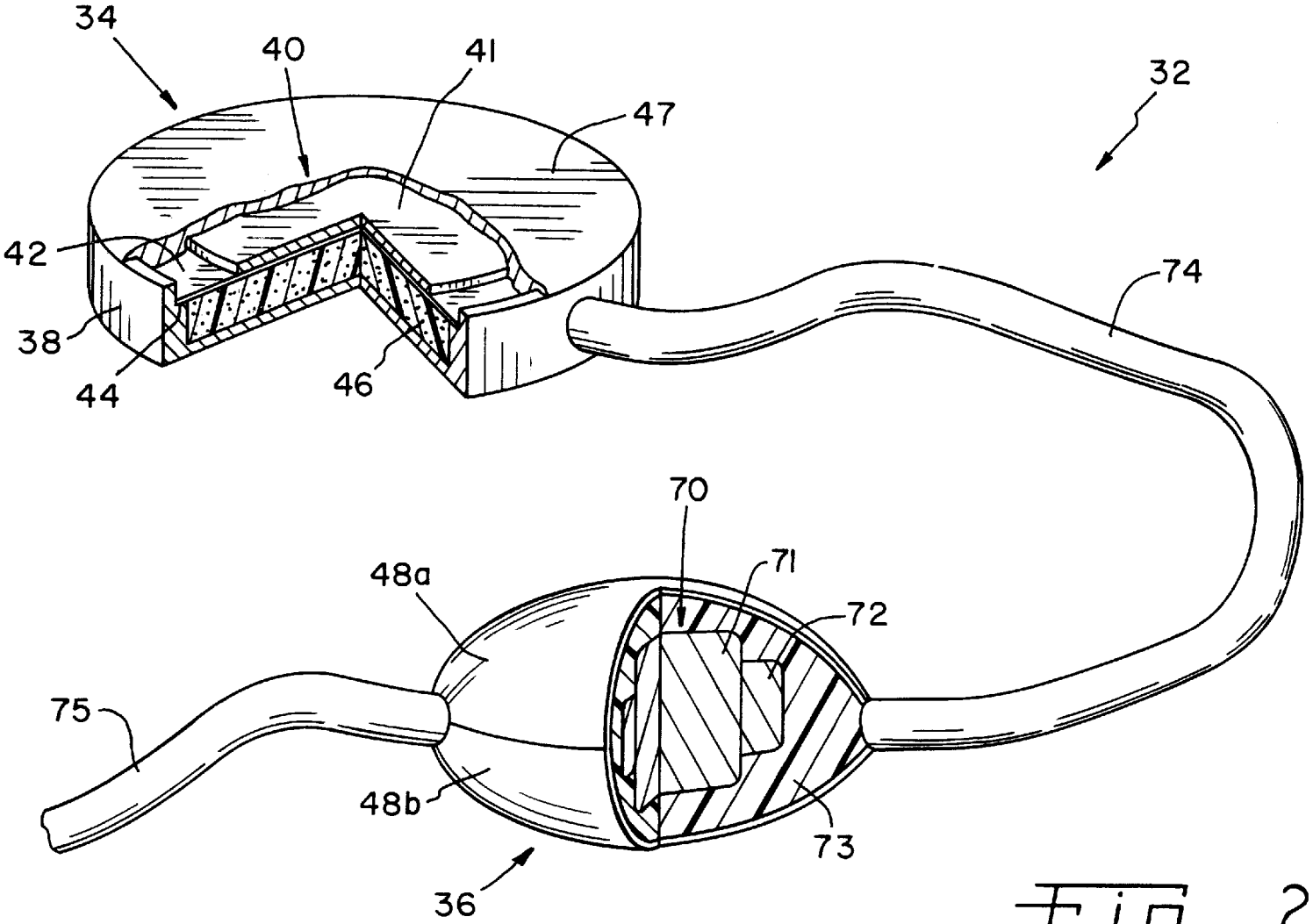
FIG. 2 is a front perspective view of another embodiment of a speaker in accordance with the principles of the present invention, showing the speaker and transformer therefor in partial section.

With reference now to FIG. 2, there is shown low profile speaker assembly 32. Speaker assembly 32 comprises separate speaker 34 and separate transformer 36. Speaker 34 has housing 38 of a machined or thermoformed plastic such as ABS or another thermoplastic or thermoset polymer and includes an audio transducer 40. Audio transducer 40 is preferably a piezo ceramic bender such as standard piezo ceramic bender part number KBI 3526 from Projects Unlimited, Inc. of Dayton, Ohio that has a resonant frequency of 2600 Hz. Bender 40 has annular piezo ceramic element 41 and non-ceramic or metal substrate vibration element 42. In the case of the KBI 3526, piezo ceramic element 41 has a diameter of 25 mm (0.984") and a thickness of 0.28 mm (0.011"), while non-ceramic vibration element 42 is brass and has a diameter of 35 mm (1.378") and a thickness of 0.25 mm (0.010") for an overall bender 40 thickness of 0.53 mm (0.021"). Of course, other bender configurations or audio transducers may be used according to the principles of the present invention.

Depending on the application, either above or below water applications, bender 40 is situated within housing 34 in one of two ways. In above water or non-diving applications, non-ceramic element 42 is supported on its outside diameter by annular or s other configuration shelf 44, that is preferably only approximately 0.050 inches wide around its circumference. Disposed under non-ceramic portion 42 of bender 40 is closed cell foam layer 46 that provides support for bender 40 in case of compression. This helps prevent cracking the piezo ceramic element 41 of bender 40. For underwater applications, however, bender 40 is not supported by a shelf but is directly supported on closed cell foam layer 46. This allows for near uniform forces to be exerted over the entire surface area of bender 40 during such submersed applications. Again, this helps prevent cracking of piezo ceramic element 41. Disposed onto the top of bender 40 is polyurethane layer 47, preferably of a 40–60 shore A or high viscosity resin polyurethane. The profile of polyurethane layer 47 is preferably nominally hemispherical and does not extend beyond the diameter of housing 38. Cable 54, which may be a two or three conductor cable, has one end which extends into housing 38 to directly couple with bender 40.

Transformer assembly 36 includes upper housing **48*a* and lower housing 48*b* again made of a machined or thermoformed plastic such as ABS or another thermoplastic or thermoset polymer. While upper and lower housings 48*a* and 48*b* together form a football shaped housing, other shaped housings may be used such as rectangular or spherical. Disposed within housings 48*a* and 48*b* is audio transformer 70 comprised of primary winding 71 and secondary winding 72 preferably having a turns ratio of approximately 10:1 and a peak performance at approximately 25–2000 Hz. One type of audio transformer that may be used is a Radio Shack® P/N 273–1380. Surrounding transformer 70 is encapsulation potting 73 which provides protection and electrical insulation. One type of encapsulation material is an epoxy such as 20–3060, a 100% reactive potting and encapsulating epoxy resin from Epoxies, Etc. Inc. of Greenville, R. I. Other encapsulation materials may be used such as silicone or polyurethane. The other end of cable 74 extends into one side of housings 48*a* and 48*b* of transformer assembly 36 to couple with secondary winding 72. One end of cable 75, which may be a two or three conductor cable, extends into another side of housings 48*a* and 48*b* to couple with primary winding 71. Cable 75 couples at the other end with a source of electric audio signal (not shown). For strength, cables 74 and 75** may be constructed with an integral string of Kevlar® or other synthetic high tensile strength material to enhance the tensile properties of the cable construction.

Figure 3:
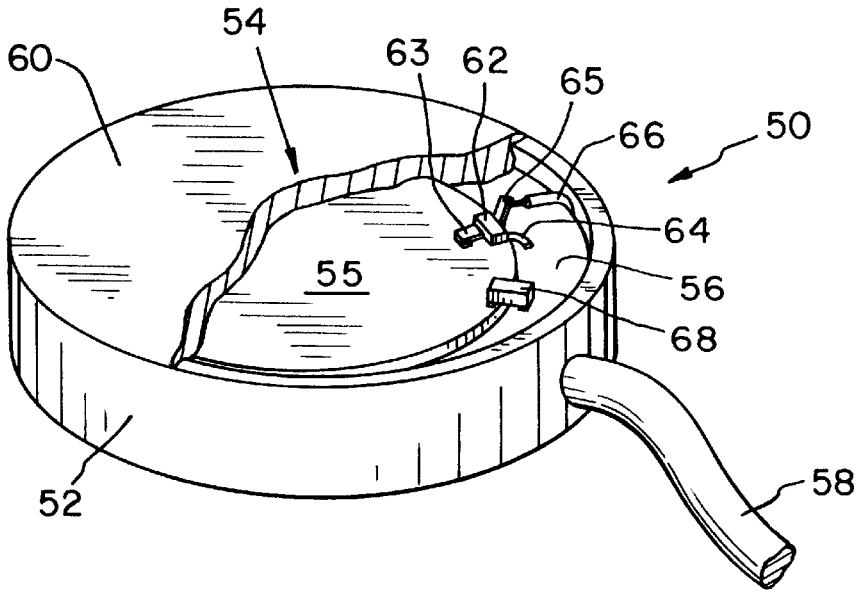
FIG. 3 is a front, partial section, perspective view of a microphone in accordance with the principles of the present invention.

With reference now to FIG. 3, there is shown bone conduction microphone 50. Microphone 50 has cup-shaped housing 52 of a machined or thermoformed plastic such as ABS or another thermoplastic or thermoset polymer. Disposed in housing 52 is audio transducer 54 for the active element which is preferably a piezo ceramic bender such as standard piezo ceramic bender part number KBI 2720 from Projects Unlimited, Inc. of Dayton, Ohio that has a resonant frequency of 2000 Hz. Bender 54 has annular piezo ceramic element 55 and non-ceramic or metal substrate vibration element 56. In the case of the KBI 2720, piezo ceramic element 55 has a diameter of 20 mm (0.787") and a thickness of 0.13 mm (0.005"), while non-ceramic vibration element 56 is brass and has a diameter of 27 mm (1.063") and a thickness of 0.10 mm (0.004") for an overall bender 54 thickness of 0.23 mm (0.009"). Of course, other bender configurations or audio transducers may be used according to the principles of the present invention.

Attached to bender 54 is Junction Field Effect Transistor (JFET) 62 with a SOT 23 configuration such as a J201 from National Semiconductor (or a Siliconix sst201). Gate 63 of JFET 62 is electrically coupled as by soldering to the silvered coating of piezo ceramic element 55 of bender 54. Source 64 of JFET 62 is electrically coupled as by soldering to metal substrate vibration element 56 acting as electrical ground. Drain 65 of JFET 62 is electrically coupled as by soldering to output conductor 66 of cable 58. The purpose of JFET 62 is to provide current and voltage amplification as close to the source as possible. This dramatically reduces noise introduction through cable 58. A ground conductor (not shown) or cable shield if used (not shown) of cable 58 which extends through housing 52, is electrically coupled as by soldering to metal substrate vibration element 56. Cable 58 preferably has a polyurethane, PVC, or other insulating jacket which will provide at least two conductors in an overall diameter of less than 0.100 inches.

Resistor 68, preferably with a value of 1 to 10 megaohms, is electrically coupled as by soldering at one end to piezo ceramic element 55 and at another end to metal substrate vibration element 56, thus draining the predominately direct current bias from the active piezoelectric ceramic element 55. Resistor 68 bleeds off DC current from active piezoelectric ceramic element 55 to maintain gate 63 of JFET 62 at a voltage whereby the small AC signals from audio received by bender 50 are amplified in the linear range of JFET 62. Disposed onto the top of bender 54 is polyurethane layer 60, preferably of a 40–60 shore A or high viscosity resin polyurethane. The profile of polyurethane layer 60 is preferably nominally hemispherical and does not extend beyond the diameter of housing 52.

It is preferred to place bender 54 within housing 52 such that the piezo ceramic element 55 side is at the bottom and in intimate connection with the housing bottom. In any case, housing 52 is filled with a hard curing epoxy, preferably the 20–3060 epoxy as mentioned above from Epoxies, Etc. Inc., with the absence of air anywhere around bender 54 and is filled only until bender 54 is completely covered and the portion of cable 58 that extends into housing 52 is covered. Preferably, microphone 50 is less than 0.100 inches thick with a total thickness around bender 54 at 0.075 inches. This can be accomplished by placing the cable attachment and any strain relief to the side of the housing but mechanically attached by means of connective moldings or appropriate adhesives. It is also desired to attach a small conductor such as wire (not shown) to electrical ground within the housing and which protrudes therefrom and is connected to a thin metallic sheath that completely covers the microphone. This aids in the elimination of electromotive. interferences such as 60 cycle hum interference, radio signal interference, or other electromagnetic disturbances.

In use, either high profile speaker 10 or low profile speaker 32 and microphone 50, or a single speaker 10 or 32, or a multiple number and combinations of speakers 10 and 32, or using only microphone 50 alone, may be placed into a supporting device, such as a helmet, to be placed in contact with a user's head. The preferred configuration is to use either high profile speaker 10 or low profile speaker 32 such that one or more of them are placed in contact with the user's head near the top or crown thereof. The speakers are preferably embedded into a soft, comfortable strap or cushioning material inside a hat, helmet or head covering such that intimate contact of the speaker is maintained against the head. The material around the speaker is best placed such that it forms a seal around the speaker and against the head without unloading pressure from the speaker against the user's head. The use of sound deadening material is most advantageous as this will result in attenuation of sounds being heard outside of the head covering, such as by a person in close proximity to the user. This is especially useful in applications such as the military or police activities where the user prefers to hear audio without that audio being detected by a bystander or by surveillance equipment. Any cables from the speakers would be routed beneath the soft comfortable material in the head covering, hat, or helmet to provide the best comfort for the user.

Microphone 50 is preferably placed into the head covering, hat or helmet such that it is maintained in intimate contact with the user's head, and most preferably on the forehead. Other locations, however, may be used such as near the rear of the head, the side of the head, near the mandibular joint, on the jaw, around or on the throat area, or near the mastoid. The microphone is maintained in contact with the chosen location by whatever means, such as elastic, or by a mechanical structure such that during normal movement, the microphone does not separate from the chosen location. Also, unwanted noise is reduced when the microphone is place in one location and maintained there without substantial movement.

Another application of microphone 50 is the use of more than one microphone in separate locations on the head, such as, without being exhaustive, two microphones place against the forehead, or one microphone on the forehead and another microphone on the back of the head. The output of the two microphones can be compared almost instantaneously by electronic means and audio/sound which is not present in both microphones concurrently (i.e. noise) can be removed. This technique completely eliminates unwanted noise.

Another system which is made from the incorporation of both the speaker and microphone of the present invention can use a single cable which connects to both the microphone(s) and speaker(s). This configuration allows for the system to be adapted to a portable single or two way radio or telephone.

Thus, the present microphone and speaker system has many uses or applications. These may include army helmets, headbands, directly taped to the head, application with Velcro®, chin straps, football helmets, bicycle helmets, race car drivers, helmet or non-helmet related sports with various attachment means, rollerblading, hard hats, goggle straps, eyeglasses, hoods, face masks, face shields, hats, baseball caps, direct hand held, fire/police helmets, mountain climbing, cellular phones, game or toy related head gear, virtual reality head gear or helmets, fetal heartbeat monitors, stethoscopes, and mechanical troubleshooting such as for engine diagnostics, only to name a few without being an exhaustive list.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A bone conduction audio system comprising:

a speaker adapted to be placed in contact with the head area of a user; and a microphone adapted to be in contact with the head area of a user;

said speaker including a speaker housing, a first audio transducer disposed within said speaker housing, a foam layer disposed within said speaker housing and in contact with a side of said first audio, transducer, a urethane layer disposed over another side of said first audio transducer, a first conductor electrically coupled to said first audio transducer, a second conductor electrically coupled to said first audio transducer, and an audio transformer operably coupled to said first and second conductors and said first audio transducer;

said microphone including a microphone housing, a second audio transducer disposed within said microphone housing and electrically coupled to a first microphone output conductor, a transistor electrically coupled to said second audio transducer and a second microphone output conductor, a resistor electrically coupled to said second audio transducer, and potting material encasing said second audio transducer, said transistor, and said resistor within said microphone housing.

2. The bone conduction audio system of claim 1, wherein said first and second audio transducers are piezoelectric ceramic benders, each having a ceramic element coupled to a metallic element.

3. The bone conduction audio system of claim 2, wherein said transistor is a JFET having a gate, a source , and a drain, said gate electrically coupled to said ceramic element of said second audio transducer, said source electrically coupled to said metallic element of said second audio transducer, and said drain coupled to said second microphone output conductor, and said resistor is electrically coupled between said ceramic element of said second audio transducer and said metallic element of said second audio transducer.

4. The bone conduction audio system of claim 2, wherein said ceramic element of said second audio transducer is positioned adjacent a bottom of said microphone housing.

5. The bone conduction audio system of claim 2, wherein said potting material is epoxy.

6. The bone conduction audio system of claim 2, wherein said microphone housing is cup-shaped, said first and second microphone output conductors extend through a bore in said microphone housing, and further including a urethane layer over an open end of said cup-shaped microphone housing.

7. The bone conduction audio system of claim 2, wherein said speaker housing includes a shelf supporting said first audio transducer.

8. The bone conduction audio system of claim 2, wherein said audio transformer and said first audio transducer are disposed within said speaker housing and further including a potting material surrounding said audio transformer.

9. The bone conduction audio system of claim 2, further comprising a third housing, said audio transformer disposed within said third housing and surrounded by a potting material, and electrically coupled to said first and second conductors.

* * * * *